US005346122A

United States Patent [19]

Leader et al.

[11] Patent Number: 5,346,122

[45] Date of Patent: Sep. 13, 1994

[54] OVAL SHAPED BOX

[75] Inventors: Elliott Leader, Paramus; Ezra Hedaya, Eatontown, both of N.J.

[73] Assignee: Royal Sound Co., Inc., Eatontown, N.J.

[21] Appl. No.: 995,999

[22] Filed: Dec. 23, 1992

[51] Int. Cl.[5] ..... B65D 25/54

[52] U.S. Cl. ..... 229/162; 206/523; 206/45.31; 229/182.1

[58] Field of Search ..... 229/40, 162, 182.1; 206/523, 524, 587, 45.31

[56] References Cited

U.S. PATENT DOCUMENTS

| | | | |
|---|---|---|---|
| 3,253,703 | 5/1966 | Ettin | 229/40 X |
| 3,368,734 | 2/1968 | Wamberg | 229/162 X |
| 3,971,035 | 7/1976 | Maxwell | 206/523 X |
| 4,385,692 | 5/1983 | Eldridge, Jr. | 206/523 X |
| 4,763,789 | 8/1988 | Questel et al. | 206/523 X |
| 5,060,853 | 10/1991 | Gulliver et al. | 229/162 |

FOREIGN PATENT DOCUMENTS

| | | | |
|---|---|---|---|
| 2626251 | 7/1989 | France | 206/523 |
| 363614 | 6/1961 | Switzerland | 206/523 |
| 1270208 | 4/1972 | United Kingdom | 229/40 |

*Primary Examiner*—Allan N. Shoap
*Assistant Examiner*—Christopher McDonald
*Attorney, Agent, or Firm*—Ezra Sutton

[57] ABSTRACT

An oval-shaped box construction including a foam enclosure for housing the product and a viewing window to observe the product in the box.

10 Claims, 4 Drawing Sheets

OVAL SHAPED BOX

FIELD OF THE INVENTION

This invention relates to the construction of an oval-shaped box for packaging an electronic or similar product.

BACKGROUND OF THE INVENTION

Boxes for the packaging of electronic products have been designed in previous years. However, these prior box designs are not easy to assemble, and they do not provide an efficient and economical method of packaging.

It is desirable to provide a box design which is aesthetically pleasing in shape and which allows for an easier and a potentially less damaging packaging process. For example, it is desirable to have the product slide into the box, in contrast to being dropped into the box. It would also be desirable to have a box which allows for the viewing of the product without removing the product from the box.

Accordingly, it is an object of the present invention to provide a box for packaging electronic and other products which is aesthetically pleasing, economical to manufacture, easy to assemble, quick and simple to package, and safe for the product being packaged.

SUMMARY OF THE INVENTION

In accordance with the principles of the present invention, there is provided a box blank having a plurality of integrally-formed members which are folded and cooperate to construct an oval-shaped box for the packaging of an electronic or similar product In addition, there is provided a foam enclosure comprised of two foam sections that house the product. The foam enclosure is insertable into the product-receiving compartment of the box prior to closing the box. A viewing window is also provided on the box and foam enclosure for the purpose of viewing the product while it is contained within the box.

BRIEF DESCRIPTION OF THE DRAWINGS

Further objects, features, and advantages of the present invention will become apparent upon consideration of the detailed description of the presently-preferred embodiment, when taken in conjunction with the accompanying drawings wherein.

DETAILED DESCRIPTION OF PREFERRED EMBODIMENT

Figure 1:
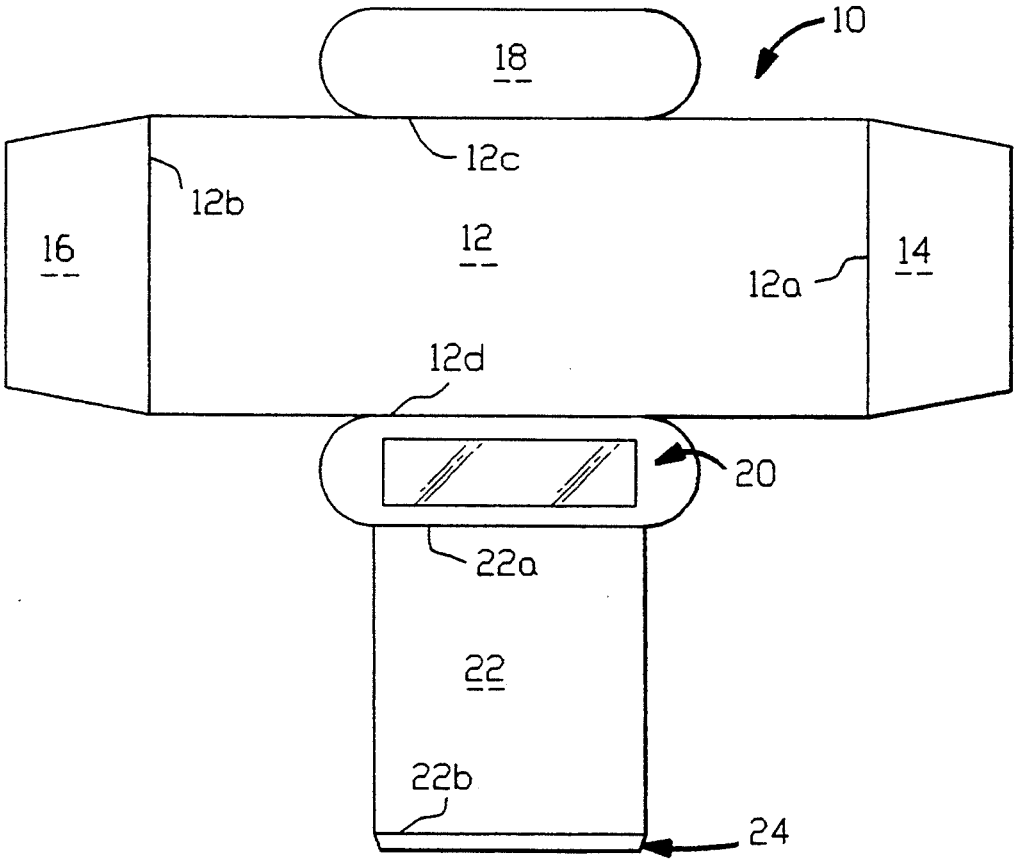
FIG. 1 is a plan view of the box blank which forms the oval-shaped box when folded.

Referring to FIG. 1, there is shown a blank 10 for an unassembled oval-shaped box for packaging an electronic product or the like. The blank 10 includes a base member 12 having a plurality of integrally-formed members. A first side flap 14 is attached to the base member 12 along side 12*a*. A second side flap 16 is attached to the base member 12 along side 12*b*. A first oval end flap 18 is connected along side 12*c* of base member 12, and a second oval end flap 20 is connected to side 12*d* of the base member 12. A bridging flap 22 is connected to one side 22*a* of the second oval end flap 20, and an attachment flap 24 is connected to a second side 22*b* of bridging flap 22.

The oval-shaped box blank 10 is made of paperboard or similar material.

Figure 2:
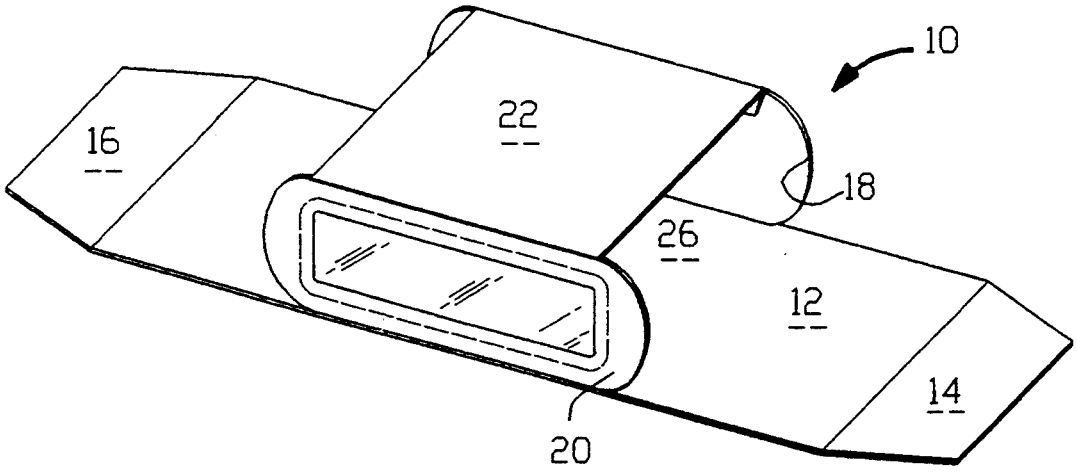
FIG. 2 illustrates a partially-assembled box and the product-receiving compartment which is formed thereby.

Referring to FIG. 2, a product-receiving compartment 26 is formed by assembling the oval-shaped box blank 10. This product-receiving compartment 26 is achieved by folding up the first oval end flap 18 along side 12*c* of base member 12, folding up the second oval end flap 20 along side 12*d*, folding the bridging flap 22 about side 22*a*, and lastly, folding the attachment flap 24 about side 22*b*. This forms the product-receiving compartment 26 when the attachment flap 24 is connected to the first oval end flap 18 by glue, adhesive, or in a similar manner.

Figure 3:
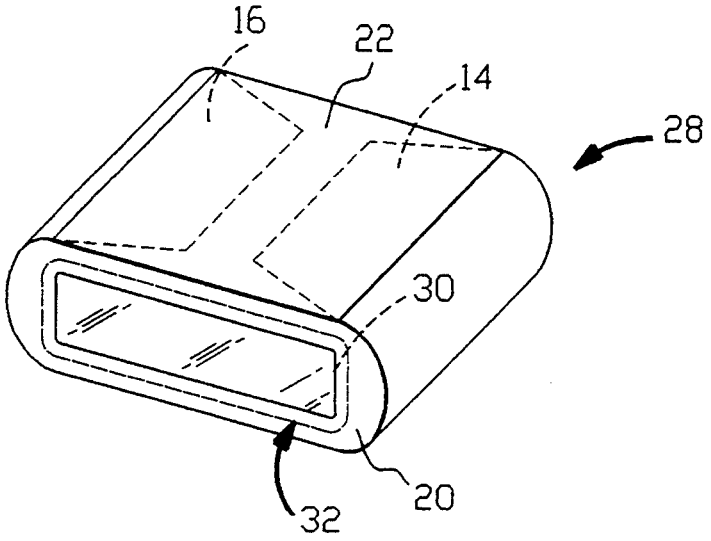
FIG. 3 is a perspective view of the fully-assembled box, showing the side flaps inserted to close the box.

Referring to FIG. 3, the first side flap 14 and the second side flap 16 are shown folded and inserted into the product-receiving compartment 26 to close the box and form the configuration of an oval-shaped box 28.

Figure 4:
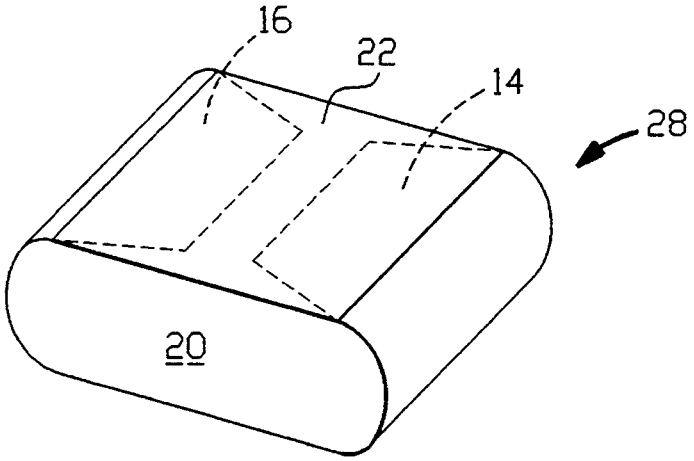
FIG. 4 is a perspective view of the fully-assembled box that includes a viewing window as a variation in the design.

FIG. 4 shows a variation of FIG. 3, wherein a viewing window 30 has been cut out of the second oval end flap 20. The viewing window 30 is covered by acetate or other transparent material 32.

Figure 5:
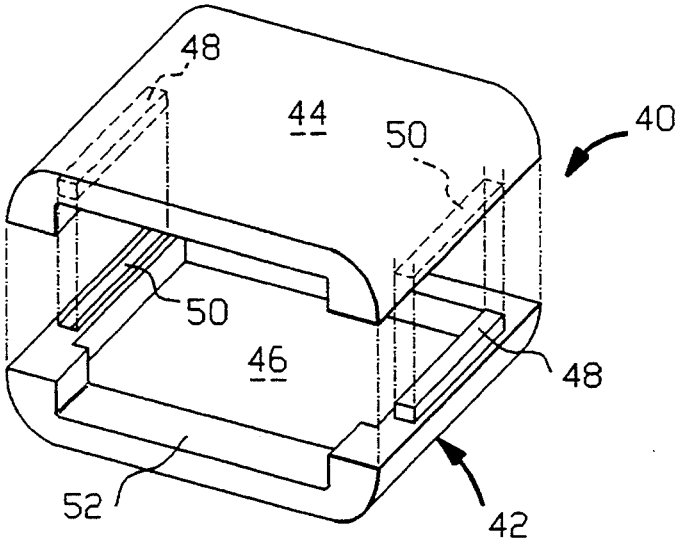
FIG. 5 shows the two foam sections which cooperate to form a foam enclosure for the purpose of housing the product.
Figure 6:
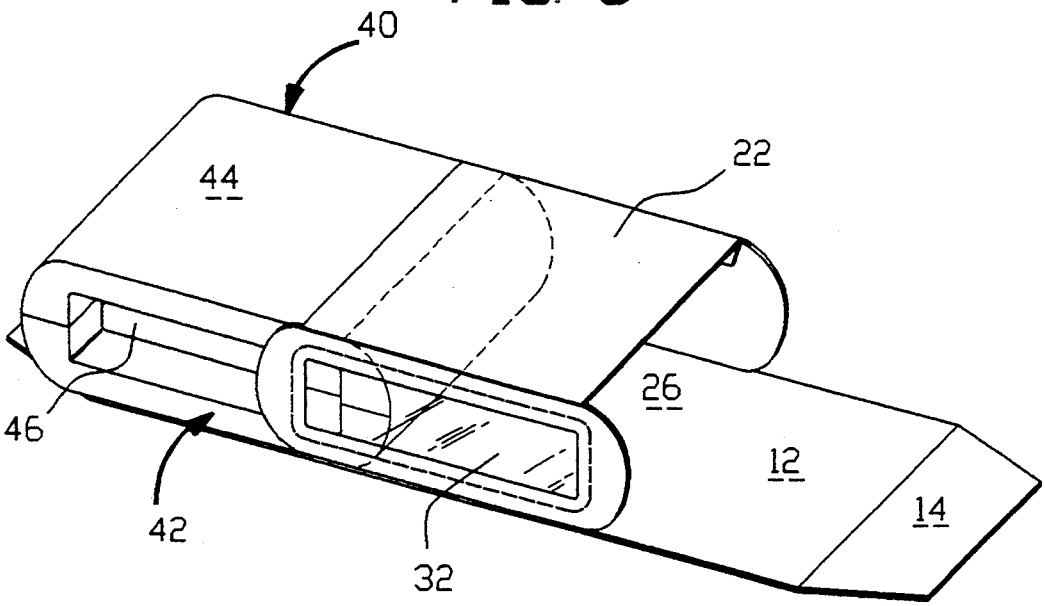
FIG. 6 shows the foam enclosure sliding into the product-receiving compartment of the box.

Referring to FIGS. 5 and 6, a first foam section 42 and a second foam section 44 cooperate to form a foam enclosure 40 having a product-receiving cavity 46. The product is placed in the cavity 46 and enclosed by the first foam section 42 and the second foam section 44 which lock together by tabs 48 entering slots 50, which are formed on opposite sides of the first and second foam sections 42 and 44. A viewing area 52 has been cut out of the first and second foam sections 42 and 44 to coordinate and be aligned witch the viewing window 30.

FIG. 6 shows the easy assembly of the package of the present invention, wherein the foam enclosure 40 simply slides into the product-receiving compartment 26 of the oval-shaped box shown in FIG. 2, and then the side flaps 14 and 16 are folded and inserted into compartment 26 under flap 22.

Figure 7:
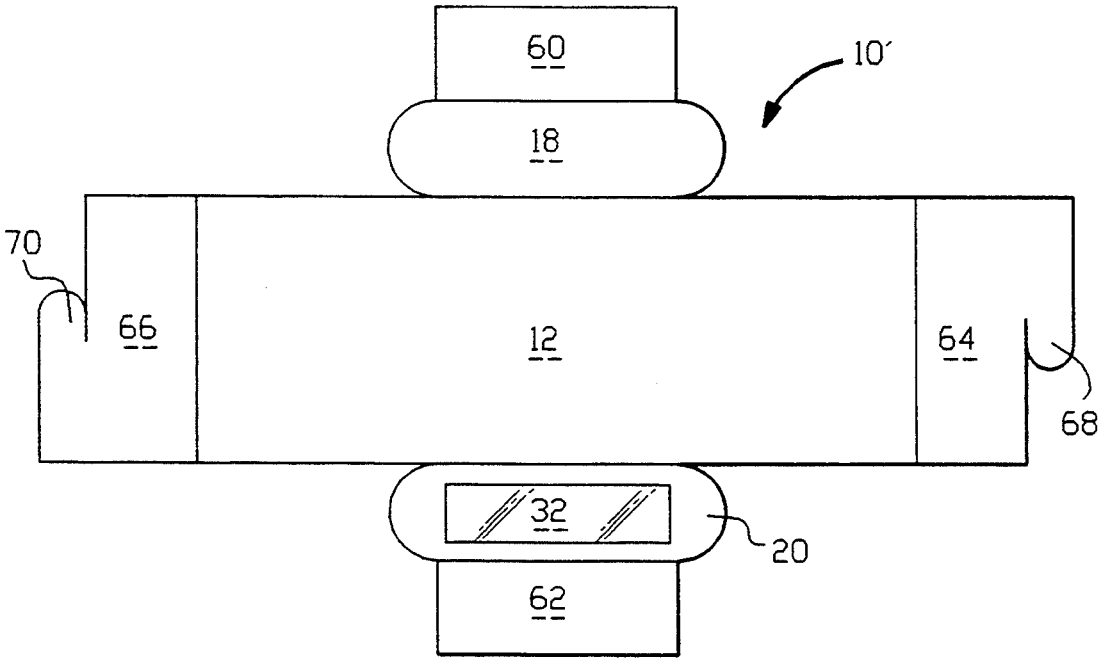
FIG. 7 is a plan view of an alternative box blank.
Figure 8:
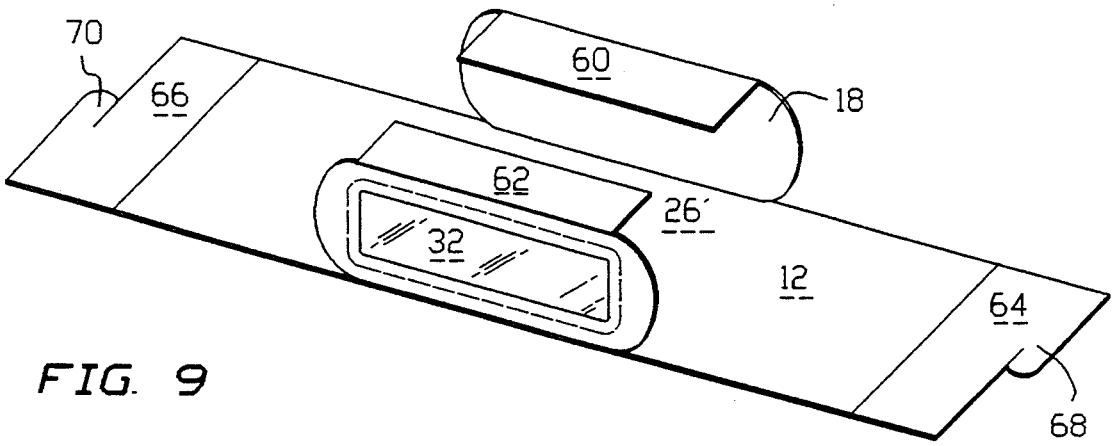
FIG. 8 is a partially-assembled box.
Figure 9:
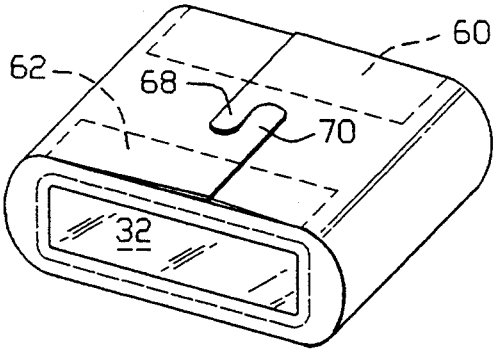
FIG. 9 is a perspective view of the fully-assembled box.

Referring to FIGS. 7, 8, and 9, an alternative embodiment 10' is shown, wherein bridging flap 22 and attachment flap 24 are replaced with bridging flaps 60 and 62. In addition, in this embodiment, side flaps 14 and 16 have been replaced with side flaps 64 and 66 having respective locking members 68 and 70. The box is assembled, as shown in FIGS. 8 and 9. As described above, the foam enclosure 40 is inserted in compartment 26' before the box is completely folded.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An oval-shaped box for packaging an electronic product and the like, comprising:

a) a base member having a plurality of members integrally formed therewith including a first side flap connected to a first side of said base member, a second side flap connected to a second and opposite side of said base member, a first oval-shaped end flap connected to a third side of said base member, a second oval-shaped end flap connected to a fourth and opposite side of said base member, a bridging flap having a first side connected to one side of said second oval end flap, and an attachment flap connected to a second side of said bridging flap;

b) said attachment flap being foldable and connectable to said first oval end flap to define a product-receiving compartment;

c) said first side flap and said second side flap being foldable and insertable into said product-receiving compartment to close said box and to form an oval configuration;

d) a first foam section and a second foam section which cooperate to form an oval-shaped foam enclosure for housing a product, said foam enclosure being insertable into said product-receiving compartment prior to closing said box; and e) said first and second foam sections each having cutouts which cooperate to form an open end to define a viewing area on one end of said foam enclosure.

2. An oval-shaped box in accordance with claim 1, wherein one of said first and second oval end flaps includes a cutout to form a viewing window.

3. An oval-shaped box in accordance with claim 1, wherein said box is formed of paperboard.

4. An oval-shaped box in accordance with claim 1, wherein each of said first and second foam sections includes a locking tab and slot for locking said first and second foam sections together.

5. An oval-shaped box in accordance with claim 2, further including a cover formed of transparent material for covering said viewing window.

6. An oval-shaped box in accordance with claim 5, wherein said cover for said viewing window is attached to said second oval end flap by glue.

7. An oval-shaped box in accordance with claim 1, wherein said attachment flap is connected to said first oval end flap by glue.

8. An oval-shaped box in accordance with claim 1, wherein one of said first and second oval end flaps includes a cutout to form a viewing window and wherein said viewing window is aligned with said viewing area of said foam enclosure.

9. An oval-shaped box for packaging an electronic product and the like, comprising:

a) a base member having a plurality of members integrally formed therewith including a first side flap connected to a first side of said base member, a second side flap connected to a second and opposite side of said base member, a first oval-shaped end flap connected to a third side of said base member, a second oval-shaped end flap connected to a fourth and opposite side of said base member, a first bridging flap connected to one side of said first oval end flap, and a second bridging flap connected to one side of said second oval end flap;

b) said first and second bridging flaps being foldable into a plane parallel to said base member to define a product-receiving compartment;

c) said first side flap and said second side flap each having a locking member for engaging each other to close said product-receiving compartment to close said box and to form an oval configuration;

d) a first foam section and a second foam section which cooperate to form an oval-shaped foam enclosure for housing a product, said foam enclosure being insertable into said product-receiving compartment prior to closing said box; and e) said first and second foam sections each having cutouts which cooperate to form an open end to define a viewing area on one end of said foam enclosure.

10. An oval-shaped box in accordance with claim 9, wherein one of said first and second oval end flaps includes a cutout to form a viewing window.

* * * * *